US006157791A

United States Patent [19]

Haines et al.

[11] Patent Number: 6,157,791

[45] Date of Patent: Dec. 5, 2000

[54] SENSING MEDIA PARAMETERS

[75] Inventors: Robert E. Haines; Quintin T. Phillips; Jeffrey S. Weaver, all of Boise, Id.

[73] Assignee: Hewlett-Packard Company, Palo Alto, Calif.

[21] Appl. No.: 09/348,150

[22] Filed: Jul. 6, 1999

[51] Int. Cl.[7] ..... G03G 15/00

[52] U.S. Cl. ..... 399/23

[58] Field of Search ..... 399/9, 16, 23, 399/24, 45, 389; 271/258.01, 259, 258.04, 265.01, 265.02, 265.03

[56] References Cited

U.S. PATENT DOCUMENTS

| | | | |
|---|---|---|---|
| 3,970,384 | 7/1976 | Yamamoto et al. | 270/259 X |
| 4,503,960 | 3/1985 | Koeleman et al. | 192/127 |
| 4,535,463 | 8/1985 | Ito et al. | 377/8 |
| 4,566,547 | 1/1986 | Furukawa | 177/46 |
| 4,610,530 | 9/1986 | Lehmbeck et al. | 399/45 X |
| 4,748,479 | 5/1988 | Ohira et al. . | |
| 4,835,573 | 5/1989 | Rohere et al. . | |
| 4,860,055 | 8/1989 | Ohira et al. . | |
| 4,919,410 | 4/1990 | Robinson, Jr. et al. . | |
| 4,922,294 | 5/1990 | Nakagami et al. | 399/23 X |
| 4,928,949 | 5/1990 | Ramsey et al. | 271/111 |
| 4,974,019 | 11/1990 | Nishioka et al. | 399/23 |
| 4,976,421 | 12/1990 | Kanaya . | |
| 5,078,378 | 1/1992 | Kapadia et al. . | |
| 5,270,563 | 12/1993 | Mahoney | 177/145 |
| 5,557,427 | 9/1996 | Kamiya | 399/45 X |
| 5,622,364 | 4/1997 | Dutton et al. | 271/117 |
| 5,629,672 | 5/1997 | Brown et al. | 399/23 X |
| 5,893,009 | 4/1999 | Yamada | 399/45 X |

*Primary Examiner*—Sandra Brase
*Attorney, Agent, or Firm*—Gregg W. Wisdom

[57] ABSTRACT

An embodiment of a media quantity sensing device and a media type sensing device includes a first, a second a third, and a fourth electrode. The first electrode is positioned above a media tray and the second electrode is positioned on the media tray below the media. The third and the fourth electrodes are positioned so that the media leaving the media tray passes between them. The media quantity sensing device further includes a measuring circuit coupled to a controller. The measuring circuit includes a first dual slope integrator to generate a first square wave output signal having a frequency dependent upon the dielectric constant of the media between the first electrode and the second electrode. The measuring circuit further includes a second dual slope integrator to generate a second square wave output signal having a frequency dependent upon the dielectric constant of the media between the third electrode and the fourth electrode. The measuring circuit also includes a frequency measurement unit to measure the frequencies of the first and the second square wave output signals. The controller reads the frequencies from the first and the second square wave output signals. The controller determines the media type in the media tray based upon the frequency of the first square wave output signal. Based upon the media type information, the controller selects and accesses a lookup table to determine the quantity of the media in the media tray by comparing the frequency of the second square wave output signal to values in the lookup table.

20 Claims, 7 Drawing Sheets

SENSING MEDIA PARAMETERS

FIELD OF THE INVENTION

This invention relates to the sensing of media parameters in imaging systems. More particularly, this invention relates to the determination of media quantity in an imaging system such as a printer.

BACKGROUND OF THE INVENTION

In imaging systems, such as inkjet printers, electrophotographic printers, electrophotographic copiers, fax machines, or the like, it is important to accurately sense the quantity of media stored in a media input device such as a media tray. For efficient processing of imaging jobs, it is important that the imaging system determine if sufficient media remains in the input device to complete the imaging job. Therefore, a need exists for an accurate, low cost apparatus for determining the quantity of media in a media input device.

SUMMARY OF THE INVENTION

Accordingly, in a system for producing an image on media, an apparatus for generating a first parameter related to a quantity of media in a media input device includes a first electrode and a second electrode positioned opposite the first electrode so that the media in the media input device can be located between the first electrode and the second electrode. The apparatus for determining the quantity of media also includes a measuring circuit coupled to the first electrode and the second electrode. The measuring circuit includes a configuration for generating the first parameter based upon a first property of a dielectric between the first electrode and the second electrode.

A system for producing an image on media includes a first electrode, a second electrode, and a media input device. A method for determining a quantity of the media in the media input device includes generating a first value based upon a first property of a dielectric between the first electrode and the second electrode. The method also includes determining the quantity of the media in the media input device based upon the first value.

A system to produce an image on media loaded from a media input device includes an imaging device. The system further includes an apparatus for determining a quantity of the media in the media input device coupled to the imaging device. The apparatus for determining a quantity of the media in the media input device includes a first electrode and a second electrode positioned opposite the first electrode so that the media can be located in the media input device between the first electrode and the second electrode. The apparatus for determining a quantity of the media also includes a measuring circuit coupled to the first electrode and the second electrode. The measuring circuit includes a configuration for generating the first parameter based upon a first property of a dielectric between the first electrode and the second electrode. The apparatus for determining a quantity of the media also includes a controller arranged to receive the first parameter from the measuring circuit and to determine the quantity of media in the media input device based upon the first parameter.

DESCRIPTION OF THE DRAWINGS

A more thorough understanding of embodiments of the invention may be had from the consideration of the following detailed description taken in conjunction with the accompanying drawings in which.

DETAILED DESCRIPTION OF THE DRAWINGS

The present invention is not limited to the specific exemplary embodiments illustrated in this specification. Although the embodiments of the media type sensing device and the media quantity sensing device will be discussed in the context of a monochrome electrophotographic printer, one of ordinary skill in the art will recognize by understanding this specification that the media type sensing device and the media quantity sensing device have applicability in both color and monochrome electrophotographic imaging systems, inkjet imaging systems, electrophotographic copiers, fax machines, or other devices that store media for use in the device. Other devices that store media for use in the device and could benefit from the media type sensing device include, for example, large printing presses or ticket dispensing systems that store tickets.

Figure 1:
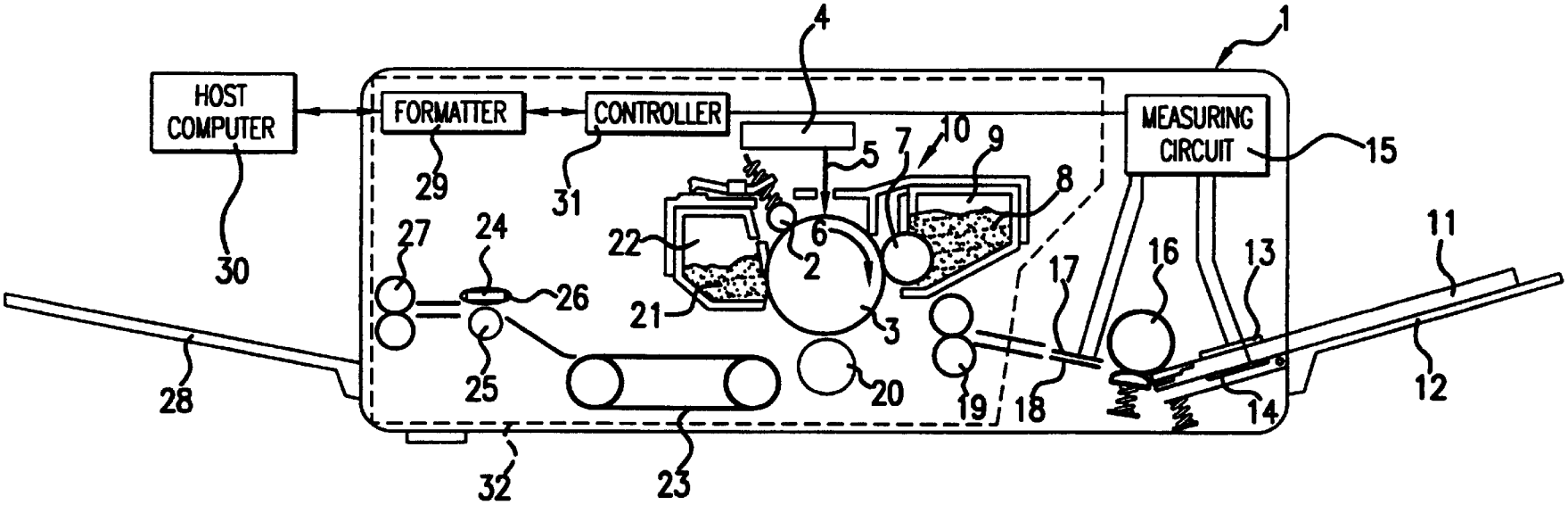
FIG. 1 is a simplified cross section of an electrophotographic printer including embodiments of the media type sensing device and the media quantity sensing device.

Referring to FIG. 1, shown is a simplified cross sectional view of an exemplary electrophotographic imaging system, such as electrophotographic printer 1, containing an embodiment of the media type and the media quantity sensing device. Charge roller 2 is used to charge the surface of photoconductor drum 3 to a predetermined voltage. A laser diode (not shown) inside laser scanner 4 emits a laser beam 5 that is pulsed on and off as it is swept across the surface of photoconductor drum 3 to selectively discharge the surface of the photoconductor drum 3. Photoconductor drum 3 rotates in the clockwise direction as shown by the arrow 6.

Developer roller 7 is used to develop the latent electrostatic image residing on the surface of photoconductor drum 3 after the surface voltage of the photoconductor drum 3 has been selectively discharged. Toner 8 that is stored in the toner reservoir 9 of electrophotographic print cartridge 10 moves from locations within the toner reservoir 9 to the developer roller 7. A magnet located within the developer roller 7 magnetically attracts the toner to the surface of the developer roller 7. As the developer roller 7 rotates in the counterclockwise direction, the toner on the surface of the developer roller 7, located opposite the areas on the surface of photoconductor drum 3 that are discharged, is moved across the gap between the surface of the photoconductor drum 3 and the surface of the developer roller 7 to develop the latent electrostatic image.

Media, such as print media 11, is stored in a media input device, such as media tray 12. An embodiment of the media quantity sensing device includes a first plate 13 located above the print media 11 stored in media tray 12 and a second plate 14 located beneath the print media 11 stored in media tray 12. First plate 13 could be attached to media tray 12 or it could be attached to electrophotographic printer 1 for support. Likewise, second plate 14 could be attached to media tray 12 or supported by attachment to electrophotographic printer 1. In the embodiment of the media quantity sensing device shown in FIG. 1, first plate 13 is positioned above the supporting surface of media tray 12 so that with media tray 12 fully loaded with print media 11, a very small gap exists between print media 11 and first plate 13. Additionally, in the embodiment of the media quantity sensing device shown in FIG. 1, second plate 14 is located below print media 11 on the upward facing surface of media tray 12 so that print media 11 rests upon second plate 14. First plate 13 and second plate 14 are electrically coupled to measuring circuit 15.

When printing is initiated by electrophotographic printer 1, a unit of print media 11 is pulled by pickup roller 16 into the media path of the electrophotographic printer 1. An embodiment of the media type sensing device includes a third plate 17 located above the path print media 11 follows as it leaves pickup roller 16 and a fourth plate 18 located below the path print media 11 follows as it leaves pickup roller 16. Both third plate 17 and fourth plate 18 could be supported by attachment to electrophotographic printer 1. Third plate 17 and fourth plate 18 are positioned relative to the path followed by print media 11 so that they are both in close proximity to the top and bottom surface of print media 11 as it passes by third plate 17 and fourth plate 18.

Print media 11 moves through the drive rollers 19 so that the arrival of the leading edge of print media 11 below photoconductor drum 3 is synchronized with the rotation of the region on the surface of photoconductor drum 3 having a latent electrostatic image corresponding to the leading edge of print media 11. As the photoconductor drum 3 continues to rotate in the clockwise direction, the surface of the photoconductor drum 3, having toner adhered to it in the discharged areas, contacts the print media 11 that has been charged by transfer roller 20 so that it attracts the toner particles away from the surface of the photoconductor drum 3 and onto the surface of the print media 11. The transfer of toner particles from the surface of photoconductor drum 3 to the surface of the print media 11 is not completely efficient and therefore some toner particles remain on the surface of photoconductor drum 3. As photoconductor drum 3 continues to rotate, toner particles that remain adhered to its surface are removed by cleaning blade 21 and deposited in toner waste hopper 22.

As the print media 11 moves in the paper path past photoconductor drum 3, conveyer 23 delivers the print media 11 to fuser 24. Print media 11 passes between pressure roller 25 and the sleeve 26 surrounding fuser 24. Pressure roller 25 forces print media 11 against sleeve 26 deforming sleeve 26. Pressure roller 25 provides the drive force to rotate sleeve 26 around fuser 24 as pressure roller 25 rotates. At fuser 24, heat is applied to print media 11 through the sleeve 26 so that the toner particles are fused to the surface of print media 11. Output rollers 27 push the print media 11 into the output tray 28 after it exits fuser 24.

Formatter 29 receives print data, such as a display list, vector graphics, or raster print data, from the print driver operating in conjunction with an application program in host computer 30. Formatter 29 converts this relatively high level print data into a stream of binary print data. Formatter 29 sends the stream of binary print data to controller 31. In addition, formatter 29 and controller 31 exchange data necessary for controlling the electrophotographic printing process. Controller 31 supplies the stream of binary print data to laser scanner 4 synchronized with the rotation of the scanning mirror included in laser scanner 4. The binary print data stream sent to the laser diode n laser scanner 4 pulses the laser diode to create the latent electrostatic image on photoconductor drum 3.

In addition to providing the binary print data stream to laser scanner 4, controller 31 controls a high voltage power supply (not shown in FIG. 1) to supply voltages and currents to components used in the electrophotographic processes such as charge roller 2, developer roller 7, and transfer roller 20. Furthermore, controller 31 controls the drive motor (not shown in FIG. 1) that provides power to the printer gear train and controller 31 controls the various clutches and paper feed rollers necessary to move print media 11 through the media path of electrophotographic printer 1. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference into this specification.

At a high level, electrophotographic printer 1 includes an imaging device, an embodiment of which is imaging device 32, coupled to embodiments of the media type sensing device and the media quantity sensing device. Imaging device 32 performs the operations necessary to form an image on media 11. Imaging device 32 includes assemblies, such as laser scanner 4, photoconductor drum 3, transfer roller 20, necessary for forming the image on media 11. The media type sensing device and the media quantity sensing device are coupled to imaging device 32 to supply information used to optimize the formation of the image on media 11.

Figure 2:
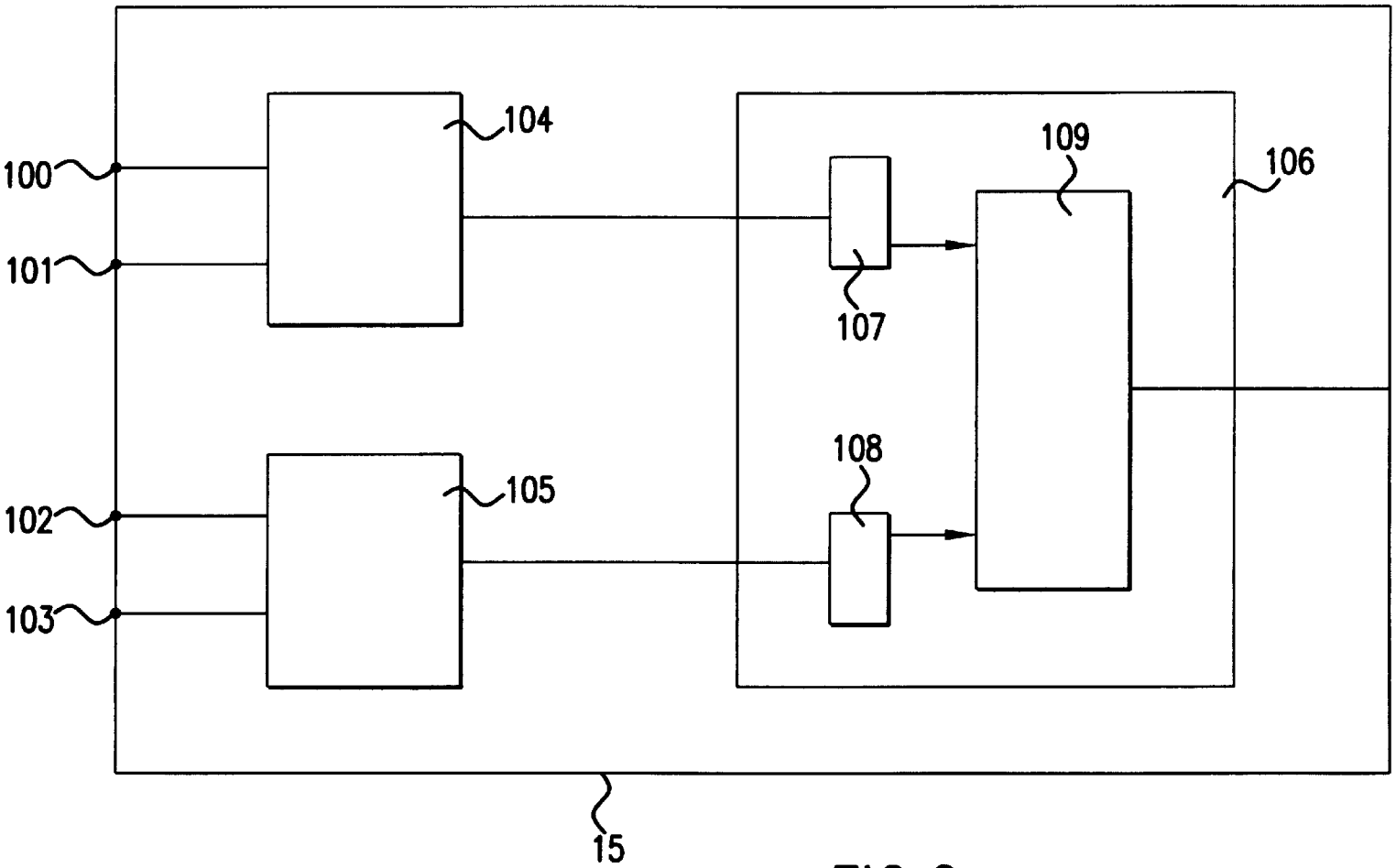
FIG. 2 shows a simplified schematic of a measuring circuit.

Shown in FIG. 2 is a simplified schematic of measuring circuit 15. The first plate 13, second plate 14, third plate 17, and fourth 18 plate are electrically coupled to measuring circuit 15 between, respectively, first node 100 and second node 101, third node 102, and fourth node 103. Measuring circuit 15 includes a first 104 and a second 105 dual slope integrator circuit that each generate a square wave output signal. The frequency of the square wave output signals generated by the first 104 and second 105 duel slope integrator circuits varies depending upon the property of a dielectric (determined primarily by a dielectric constant of the media 12) between the respective nodes associated with each of the dual slope integrators. As the capacitance between the respective nodes to which the first 104 and second 105 dual slope integrator circuits are coupled increases, the frequency of the square wave output signals decreases. The principle of operation of the first 104 and the second 105 dual slope integrators are the same. However, because of the difference in the expected range of capacitance values between first plate 13 and second plate 14 and third plate 17 and fourth plate 18, the values of at least some of the components would need to be different if it is desired that the frequencies of the square output signals generated by the first 104 and second 105 dual slope integrator circuits are to be approximately equal.

Figure 3:
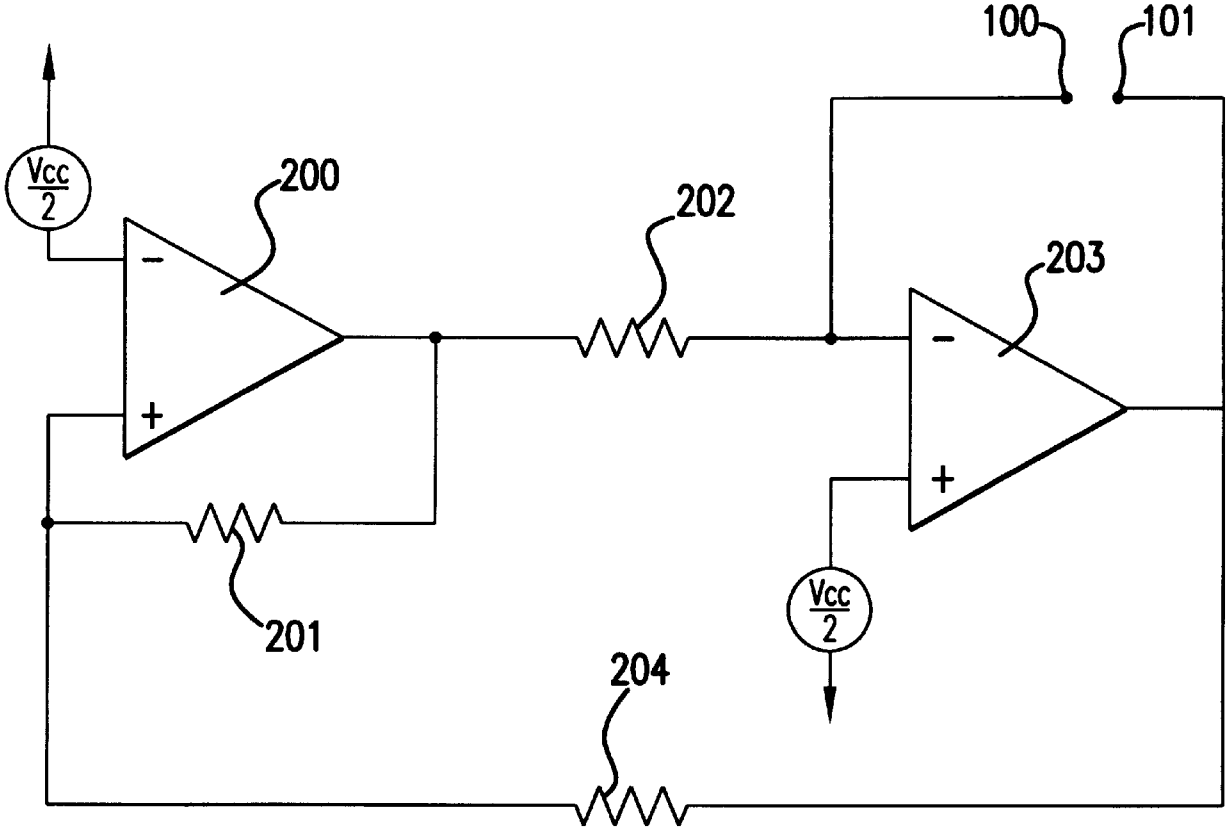
FIG. 3 shows a simplified schematic of a dual slope integrator.

Shown in FIG. 3 is a simplified schematic of first dual slope integrator 104. Second dual slope integrator 105 is configured similarly and coupled to third node 102 and fourth node 103. First dual slope integrator circuit 104 includes a first operational amplifier 200 with a first resistor 201 coupled between the output and the non-inverting input. The positive feedback provided by first resistor 201 makes first operational amplifier 200 function as ea comparator. A comparator could be substituted for first operational amplifier 200. The output of first operational amplifier 200 is coupled through second resistor 202 to the inverting input of second operational amplifier 203. The inverting input of second operational amplifier 203 is also coupled to first node 100. The output of second operational amplifier 203 is coupled to the second node 101. A third resistor 204 is coupled between the output of second operational amplifier 203 and the non-inverting input of first operational amplifier 200. The inverting input of first operational amplifier 200 is coupled to a reference voltage having a value of Vcc/2. The non-inverting input of second operational amplifier 203 is coupled to a reference voltage having a value of Vcc/2.

Because of the positive feedback applied to first operational amplifier 200, its output will switch between ground and close to Vcc, the positive power supply voltage. Second operational amplifier 203 is operated in its linear region with negative feedback. As a result, the voltage at the inverting input will be held very close to the voltage at the non-inverting input, i.e. Vcc/2. Consider the case in which the voltage at the output of first operational amplifier 200 has just made the transition to a high level. At this time, the output of second operational amplifier 203 will be at its maximum value. When the voltage at the output of first operational amplifier 200 is at a high level, positive current having a magnitude of Vcc/(2×R2) will flow into the node connected to the inverting input of the second operational amplifier 203. This current is substantially constant during the time that the output of first operational amplifier 200 is at a high level because the negative feedback applied to second operational amplifier 203 holds its inverting input very close to Vcc/2. Because of this constant current, the voltage between first node 100 and second node 101 (coupled to the capacitance formed by first plate 13 and second plate 14) will increase linearly with time, thereby resulting in a triangle shaped waveform (the voltage between first node 100 and second node 101 will also decrease linearly when the output of first operational amplifier 200 is close to ground) for the voltage between node 100 and node 101. As this voltage increases, the voltage at the output of second operational amplifier 203 will drop in order to maintain the voltage at the inverting input of second operational amplifier 203 approximately equal to the voltage at the non-inverting input. As a result, the voltage at the output of second operational amplifier 203 will also have a triangle shaped waveform. The frequency of the square wave output signal of first operational amplifier 200 is determined by the value of the capacitance between first node 100 and second node 101, the value of second resistor 202 that determines the charging rate of the capacitance between first node 100 and second node 101, and the values of first resistor 201 and third resistor 204 that determine the voltage range over which the charging and discharging of the capacitance between first node 100 and second node 101 occurs.

The voltage divider formed by first resistor 201 and third resistor 204 sets a voltage at the non-inverting input of first operational amplifier 200. The voltage at the non-inverting input of first operational amplifier 200 is determined by the voltage at the output of first operational amplifier 200, the voltage at the output of second operational amplifier 203, and the values of first resistor 201 and third resistor 204. As current continues to charge the capacitance between first node 100 and second node 101, the voltage at the output of second operational amplifier 203 continues to drop. When the voltage at the non-inverting node of first operational amplifier 200 drops slightly below the voltage on the inverting node, the output of first operational amplifier 200 will switch from Vcc to ground. The voltage value of the output waveform of second operational amplifier 203 at which the output voltage of first operational amplifier 200 will switch from Vcc to ground ($V_{HL}$) is determined by the value of Vcc, the value of first resistor 201 ($R_1$), and the value of third resistor 204 ($R_3$) as:

$$V_{HL}=Vcc\times((R_1-R_3)/(2\times R_1)). \quad \text{Equation 1}$$

The voltage value of the output waveform of second operational amplifier 203 at which the output voltage of first operational amplifier 200 will switch from ground to Vcc ($V_{LH}$) is determined by the value of Vcc, the value of first resistor 201 ($R_1$), and the value of third resistor 204 ($R_3$) as:

$$V_{LH}=Vcc\times((R_1+R_3)/(2\times R_1)). \quad \text{Equation 2}$$

Equation 1 and Equation 2 provide the voltage values of the output of second operational amplifier 203 at which first operational amplifier 200 makes a transition from Vcc to ground and a transition from ground to Vcc.

The dual slope integrator is particularly well suited to measuring a small capacitance value in the presence of electrical noise. Both first 104 and second 105 dual slope integrators generate a frequency related to the capacitance between the respective nodes to which they are coupled. Because these values of capacitance are small, the measurement of the frequency is susceptible to error resulting from electrical noise. The dual slope integrator is designed to reduce the influence of electrical noise upon the measurement of the capacitance. The frequency of the square wave output signal generated by each of the first 104 and the second 105 dual slope integrators is dependent upon the integration of a current. The Integration has the effect of averaging the electrical noise affecting the voltage across the capacitance between first node 100 and second node 101 and third node 102 and fourth node 103. This averaging operation reduces the effect of the electrical noise on the output of second operational amplifier 203. Therefore, the frequency of the square wave output signal from first 104 and second 105 dual slope integrator will be less influenced by electrical noise.

The values of capacitance which first 104 and second 105 dual slope integrator are intended to measure are generally very small. Measuring circuit may need to have the capability to measure changes in capacitance that are only several tenths of a pico-farad. Because of this, measuring circuit 15 may need to be designed to have high immunity to electrical noise. At a given supply voltage (Vcc), there are several considerations involved in selecting the values of first resistor 201, second resistor 202, and third resistor 204 in order to optimize the noise immunity of first 104 and second 105 dual slope integrator. If the values of these resistors are selected so that the frequency of the square wave output signal is made too low, the current that charges the capacitance between first node 100 and second node 101 becomes so small that current noise (such as amplifier shot noise or op-amp bias currents) can significantly affect the frequency. If the values of these resistors are selected so that the frequency of the square wave output signal is made too high, the time period over which the electrical noise between first node 100 and second node 101 is averaged becomes so small that the noise voltage across the capacitance between first node 100 and second node 101 can significantly affect the frequency. Optimizing the noise immunity of the dual slope integrator involves selecting the values of first resistor 201, second resistor 202, and third resistor 204 to balance the effects of current noise and voltage noise.

In FIG. 2, frequency measurement unit 106 is connected to the output of first operational amplifier 200. Frequency measurement unit 106 includes the hardware necessary to measure the frequency of the square wave generated at the output of first operational amplifier 200 (as well including the hardware for making a similar measurement on the corresponding operational amplifier of second dual slope integrator 105). There a variety of hardware implementations of frequency measurement unit 106 that could be used to determine the frequency of the square wave generated by first 104 and second 105 dual slope integrators.

One implementation of frequency measurement unit 106 could include a first counter 107 and a second counter 108. Each of the square wave output signals generated by first 104 and second 105 dual slope integrator circuit could connect to one of the clock inputs of the two counters. When each of the square wave output signals transitions from a low level to a high level, this would cause the respective counter to increment its output signal by one. A logic circuit 109 in frequency measurement unit 106 would periodically reset the counter output to zero. Then, at predetermined time intervals after resetting first counter 107 and second counter 108, determined, for example, by counting a predetermined number of the clock pulses used to operate the logic circuit 109, the logic circuit would read the output of the first 107 and the second 108 counter. The interval of time over which the output of the counter accumulated is known by counting the number clock pulses using logic circuit 109. The number of full cycles of the square wave output signals of the first 104 and the second 105 dual slope integrator that have occurred over the time interval is known by reading the output of the counters. These values could then be used by the logic circuit to compute the frequency at the output of each of the first 104 and second 105 dual slope integrators. Additional noise immunity could be obtained by using first 107 and second 108 counter to generate multiple counter values and averaging the results. Instead of a logic circuit it would be possible to use a microprocessor operating under firmware control to reset the counters, read the counter values, and determine the frequencies of the square wave output signals based upon the counter values.

Alternatively, frequency measurement unit 106 could be implemented by sampling each of the square wave output signals to determine the frequency of each of the square wave output signals from first 104 and second 105 dual slope integrator. Based upon the values of the samples, the frequency measurement unit 106 could determine the period of each of the square wave output signals and from this compute the frequencies. To determine the frequency using sampling, frequency measurement unit 106 could use a specifically designed logic circuit or it could use a microprocessor executing firmware to compute the frequency from the samples.

The frequency measurement unit 106 is coupled to controller 31. Controller 31 reads the values representing the frequencies of each of the square wave output signals. The values of the frequencies change as the capacitance between first plate 13 and second plate 14 and third plate 17 and fourth plate 18 change. Using a lookup table accessed by controller 31, the frequency of the square wave generated by the second 105 dual slope integrator could be matched to a value in the lookup table corresponding to a specific media type to determine the media type. The media type would be used to select one of a plurality of lookup tables for accessing by controller 31. Each of the lookup tables would include data associating frequency values with media quantity for a variety of media types. The frequency of the square wave generated by the first 104 dual slope integrator could be matched to a value in the lookup table for the detected media type to determine the quantity of media present in media tray 12.

Other implementations of measuring circuit 15 are possible For example, measuring circuit could include a signal source to supply a time varying voltage between first plate 13 and second plate 14 and third plate 17 and fourth plate 18. A resistor would be connected in series between the signal source and each of the first plate 13 and the third plate 17. Each of the voltages appearing between the first plate 13 and the second plate 14 and the third plate 17 and fourth plate 18 would be measured using an analog to digital converter. The outputs of the analog to digital converter would be coupled to controller 31.

The voltage across third plate 17 and fourth plate 18 would decrease in magnitude as the capacitance between these plates increased. Because different media types have different dielectric constants, the capacitance between third plate 17 and fourth plate 18 would change depending on the media type. The magnitude of the voltage between third plate 17 and fourth plate 18 measured by an analog to digital converter could be matched to a lookup table value accessed by controller 31 to determine the media type. Concerns about electrical noise may make it necessary to perform averaging of the voltages.

Another analog to digital converter could measure the voltage between first plate 13 and second plate 14. The media type previously determined would be used to select one a plurality of lookup tables for accessing by controller 31 that match the voltage measurements to the quantity of media for a specific media type. Matching the value of the voltage between the first plate 13 and the second plate 14 to the closest value in the lookup table would indicate the media quantity. An alternative implementation of this embodiment of measurement circuit 15 could use the change in phase (relative to the signal source) of the voltage across first plate 13 and second plate 14 and third plate 17 and fourth plate 18 with capacitance to determine the media quantity and media type from a lookup table.

Still other embodiments of measurement circuit 15 are possible. The important functional capability of any embodiment of measurement circuit 15 is that it generate parameters that have values related to the property of the dielectric between the first plate 13 and second plate 14 and the third plate 17 and fourth plate 18. With these dielectric dependent parameters, whether they are voltage values, current values, frequency or the like, controller 31 can determine the media type and the media quantity.

Figure 4:
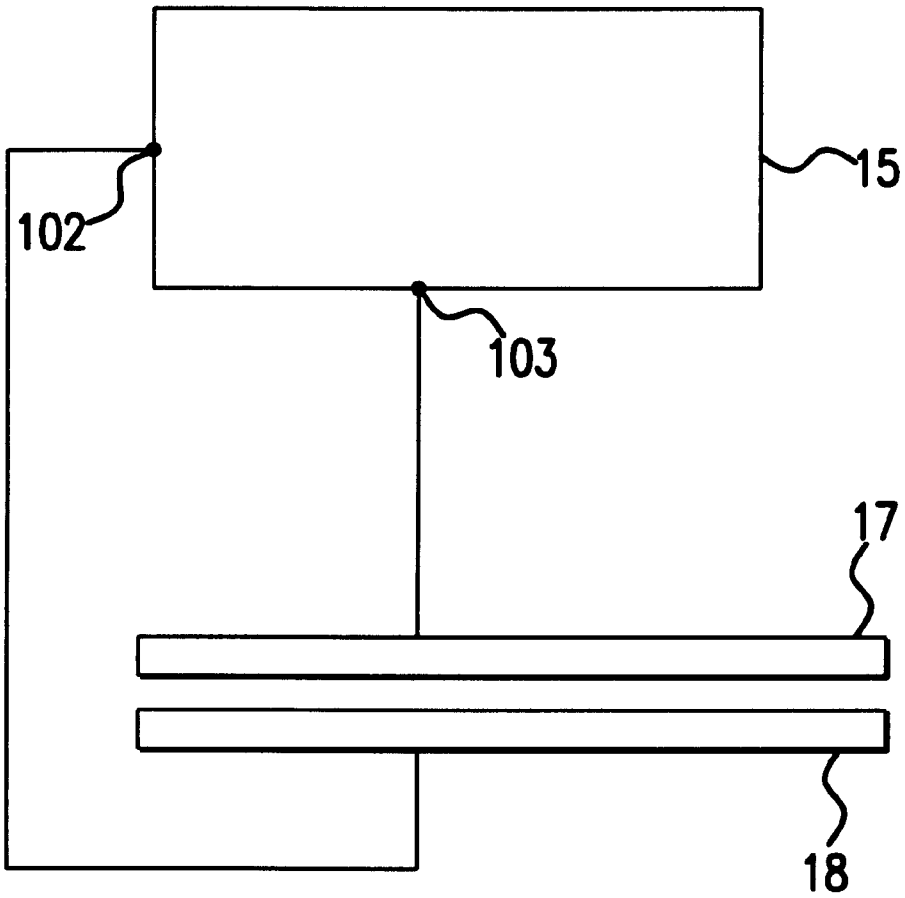
FIG. 4 shows a simplified cross section of part of an embodiment of the media type sensing device.

Shown in FIG. 4 is a simplified drawing of part of an embodiment of the media type sensing device. The media type sensing device includes third plate 17 and fourth plate 18. Third plate 17 and fourth plate 18 are positioned in opposition inside of electrophotographic printer 1 so that there is a gap of sufficient size between them to allow a unit of print media 11 having the greatest anticipated thickness to pass between third plate 17 and fourth plate 18. It should be recognized that although a relatively narrow gap between third plate 17 and fourth plate 18 is preferred in order to maximize the capacitance between the plates and the effect of the change in dielectric on the capacitance as print media 11 moves through the gap, larger gaps may be used with the necessary modifications to measuring circuit 15 and controller 31. Although FIG. 4 shows the third 17 and fourth 18 plates located inside electrophotographic printer 1, the placement of these plates is not limited to the interior of electrophotographic printer 1. As long as third plate 17 and fourth plate 18 are located so that single units of print media 11 can pass between third plate 17 and fourth plate 18, characteristics of print media 11 can be measured using the media type sensing device, regardless of the location of the plates. It should also be recognized that although third plate 17 and fourth plate 18 are shown as parallel rectangularly shaped plates, the plates may be of any shape and relative orientation so long as there is sufficient capacitance between them to provide a measurable signal.

Figure 5:
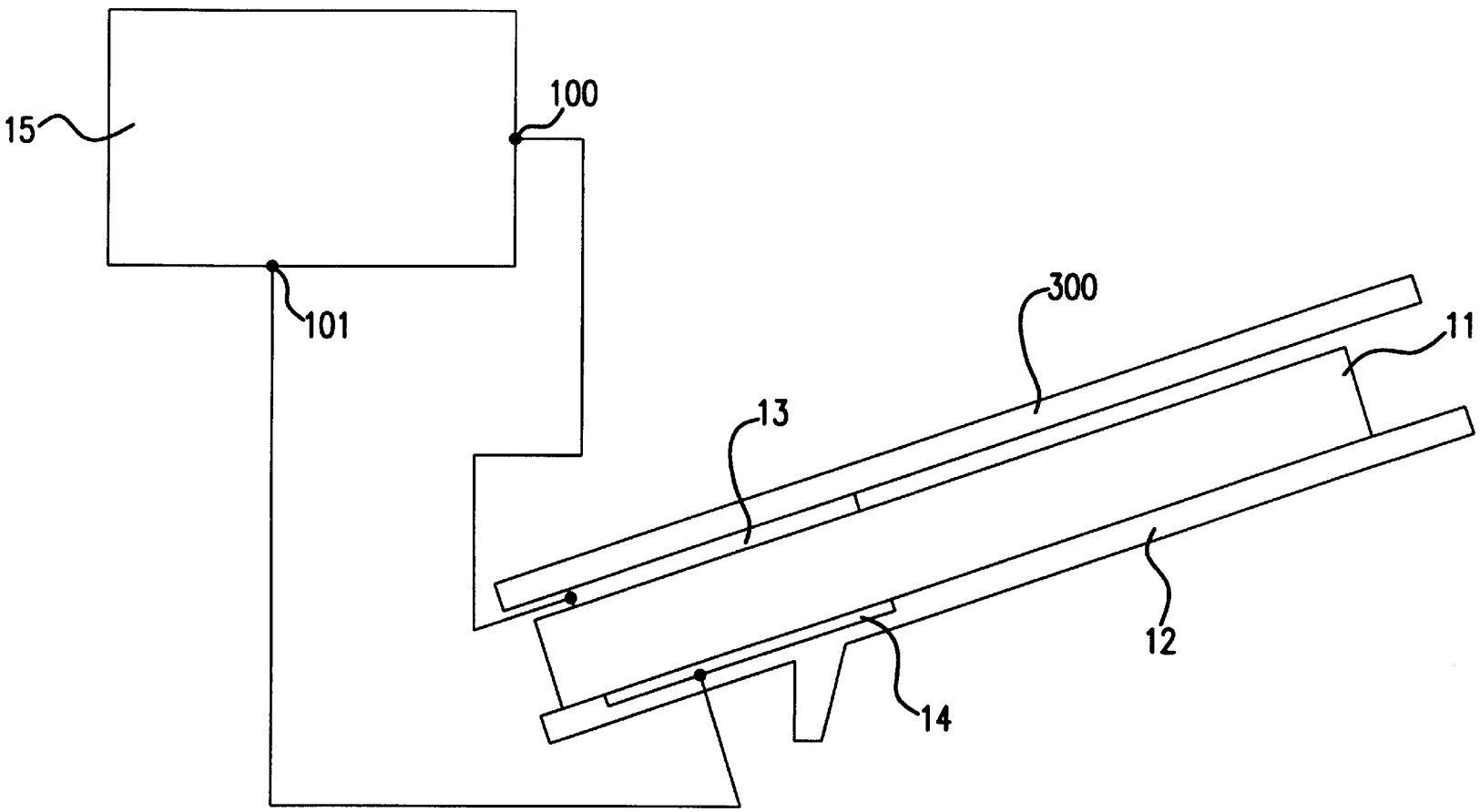
FIG. 5 shows a simplified cross section of part of an embodiment of the media quantity sensing device.

Shown in FIG. 5 is a simplified drawing of part of an embodiment of the media quantity sensing device. The media quantity sensing device includes first plate 13 and second plate 14. First plate 13 is attached to the bottom surface of a lid 300 on the media tray 12 and positioned so that with media tray 12 fully loaded with print media 11, a very small gap exists between the unit of print media 11 at the top of the stack and the surface of first plate 13. Second plate 14 is located on the bottom interior surface of media tray 12. It should be recognized that although it is desired that as small as possible a fraction of the dielectric between first plate 13 and second plate 14 is formed from non-print media dielectric, with the necessary modifications to measuring circuit 15 and controller 31, larger fractions of non-print media dielectric would work. Furthermore, although first plate 13 and second plate 14 are shown as parallel rectangularly shaped plates, the plates may be of any shape and relative orientation so long as there is a measurable change in frequency with capacitance changes.

The third plate 17 and fourth plate 18 of the media type sensing device form a parallel plate capacitor. On a parallel plate capacitor, if the area of the plates is relatively large with respect to the distance between the plates, the capacitance of a parallel plate capacitor (assuming an air dielectric) is approximately equal to the plate area multiplied by the permittivity of free space and divided by the distance between the plates. For dielectrics other than air, the value of capacitance is multiplied by the dielectric constant associated with the dielectric. The capacitance between third plate 17 and fourth plate 18 will vary depending upon the dielectric constant of print media 11. The capacitance between third plate 17 and fourth plate 18 can be modeled as two capacitors in series, one of which has the dielectric constant of print media 11 and a plate separation equal to the thickness of print media 11 and the other capacitor having a dielectric constant of air and a plate separation equal to the thickness of print media 11 subtracted from the distance between third plate 17 and fourth plate 18. The total capacitance of two capacitors connected in series is the reciprocal of the sum of the reciprocal of the capacitance values of each of the capacitors.

Third node 102 and fourth node 103 are electrically coupled, respectively, to fourth plate 18 and third plate 17. Second dual slope integrator 105 generates a square wave having a frequency based upon the capacitance between fourth node 103 and third node 102. Frequency measurement unit 106 is coupled to controller 31. Controller 31 reads the frequencies of first 104 and second 105 dual slope integrators as measured by frequency measurement unit 106 in order to determine the media type and media quantity.

Each type of print media, based upon parameters including thickness and the dielectric constant of the material from which it is made, will create a characteristic capacitance when placed between third plate 17 and fourth plate 18. For example, paper (composed of wood pulp and fillers) will have a different dielectric constant than the plastic used for overheads. Labels (composed of glue and paper) have a dielectric constant different than paper and overheads. In addition to a variation in the dielectric constant because of material, the dielectric constant of print media 11 will vary with changes in the moisture content of print media 11 and temperature, although this change is relatively small.

As previously mentioned, the frequency of the square wave output signal from second dual slope integrator 105 changes as the capacitance between third plate 17 and fourth plate 18 changes. The capacitance between third plate 17 and fourth plate 18 changes with the type of print media 11. As the capacitance increases, the frequency of the square wave Output signal from second dual slope integrator 105 is reduced. An empirical relationship between the frequency of the square wave output signal and the type of print media can be generated. This empirical relationship is accessed as a media type lookup table by controller 31.

Similarly, the frequency of the square wave output signal from first dual slope integrator 104 changes as the capacitance between first plate 13 and second plate 14 changes. The capacitance between first plate 13 and second plate 14 changes as the quantity of print media 11 in media tray 12 changes. In addition, for a given quantity of print media 11, the capacitance changes as the media type changes. For each media type having a unique capacitance characteristic, an empirical relationship between the frequency of the square wave output signal from first dual slope integrator 104 and the quantity of print media 11 in media tray 12 can be generated. These empirical relationships are used to form the media quantity lookup tables accessed by controller 31.

In alternative embodiments of measurement circuit 15 that would measure either the amplitude or the phase of the voltage appearing across first plate 13 and second plate 14 and third plate 17 and fourth plate 18, media type and media quantity lookup tables could also be generated. The lookup tables for these embodiments would include data relating the voltage amplitude or voltage phase to the media type and media quantity.

Controller 31 compares the frequency of the square wave output signal generated by second dual slope integrator 105 to the values in the lookup table to determine the type of print media passing between third plate 17 and fourth plate 18. If the frequency lies within a range of values around the value stored in the lookup table, the media type will be classified as that corresponding to the value in the lookup table. The range will depend upon the variations in dielectric constant due to differences between individual units of that media type, environmental variations, and measurement error.

Some media types may have dielectric constants very close to each other. In that case, for approximately equal thicknesses, the capacitance between third plate 17 and fourth plate 18 could be very close. To differentiate between these types of print media, the second dual slope integrator 105 could be configured to generate multiple output frequencies (by, for example, automatically changing a value of the resistor that controls the charging rate of the capacitance formed by the plates) Because it is likely that different materials will have different dielectric constant frequency responses, this measurement would provide a way to distinguish between the materials. Implementing the media type sensing device to include this feature would require a configuration of controller 31 that could access additional lookup tables for the additional frequencies at which measurements were made.

Figure 6:
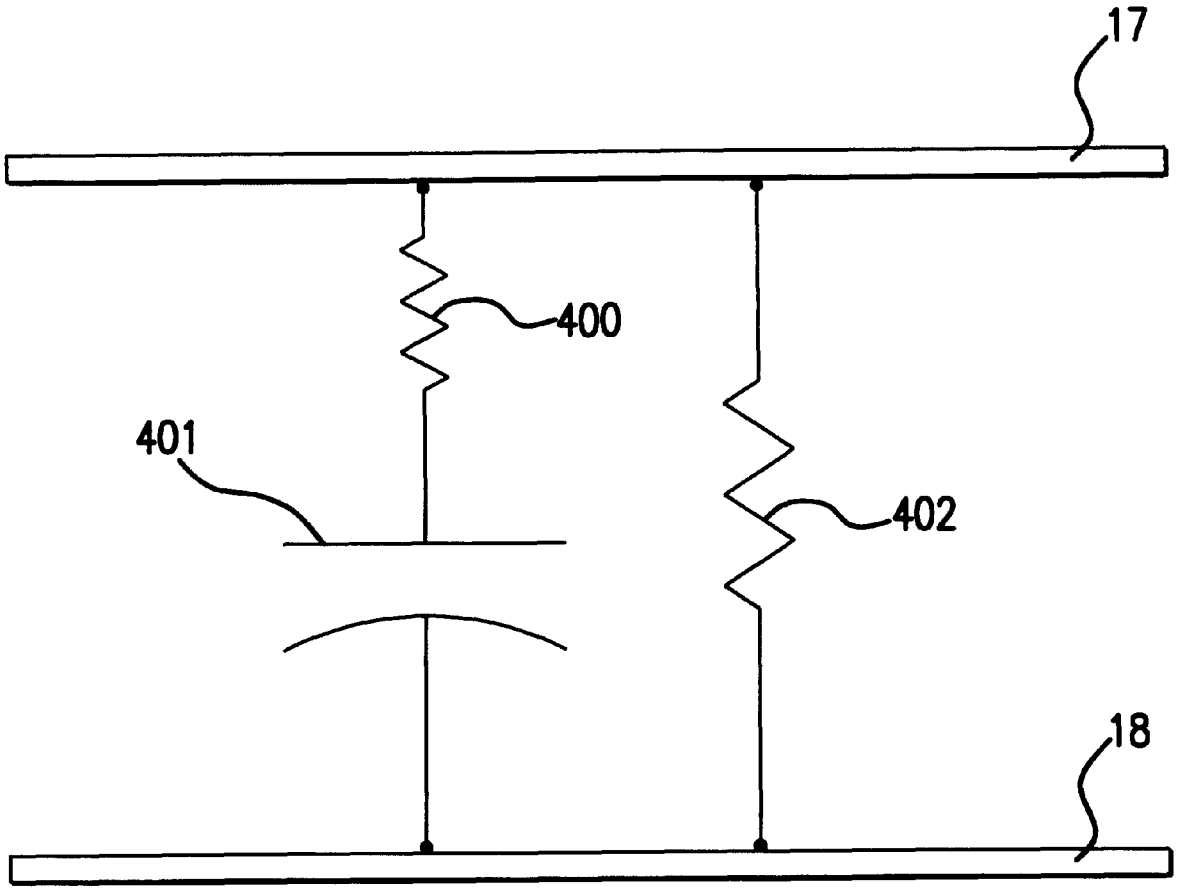
FIG. 6 shows a simplified electrical model of a dielectric between the third plate and the fourth plate shown in FIG. 4.

Shown in FIG. 6 is an electrical model of the properties of the dielectric of media 12 that can be located between third plate 17 and fourth plate 18. Another possible way to distinguish between different media types having approximately equal dielectric constants involves measurement of the dielectric loss (modeled as a resistance 400 in series with capacitance 401) of the media and/or measurement of the dielectric leakage current through the media (modeled as a resistance 402 in parallel with capacitance 401). Because the dielectric loss and/or the dielectric leakage current may be different between different media types having approximately equal dielectric constants, this provides a way in which the media types may be differentiated. The differences in dielectric loss or dielectric leakage current can be detected by careful measurement of phase or amplitude differences (resulting from applying an electrical signal between third plate 17 and fourth plate 18) between the conditions in which media is present and absent between the plates. Comparison of the measured differences to values in a lookup table could be used to determine the media type. The media type in the lookup would be selected by using the parameters relating to the capacitance between the plates and the dielectric loss and/or dielectric leakage current of media 12. This can be thought of as a two dimensional lookup table where one dimension is capacitance and the other is dielectric loss and/or dielectric leakage current.

Furthermore, the same principle could be used for determining the media quantity between first plate 13 and second plate 14. As the quantity of media in media tray 12 decreases, the dielectric leakage current between first plate 13 and second plate 14 would increase. Additionally, as the quantity of media in media tray 12 decreases, the dielectric loss associated with the media would decrease. By measuring changes in the phase or amplitude of an electrical signal applied between first plate 13 and second plate 14 and comparing these to values to values in a lookup table, the media quantity can be determined. Different quantities of different media types may result in capacitances between first plate 13 and second plate 14 very close in value. Measurements of dielectric loss and/or dielectric leakage current could be made to determine the media quantity in this situation. Measurement of dielectric leakage current for determining the media type or media quantity would best be implemented by having contact between the media and the plates. To accomplish this a mechanical means could be used to create contact between the plates and the media 12.

Identification of media type can be used in the measurement of the quantity of print media 11 in media tray. In addition, identification of media type can be used by electrophotographic printer 1 to make adjustments to the electrophotographic printing process in order to optimize print quality. Media type information could be similarly used in electrophotographic copiers. Furthermore, in other types of imaging systems, such as inkjet printers, knowledge of the media type can be useful for control of the printing process in order to optimize print quality.

The first plate 13 and the second plate 14 of the media quantity sensing device form a parallel plate capacitor. The capacitance between the first plate 13 and the second plate 14 with a full media tray 12 will vary depending upon the dielectric constant of the print media 11. Furthermore, the capacitance between first plate 13 and second plate 14 will change depending upon the amount of print media 11 loaded into media tray 12. When media tray 12 is fully loaded with print media 11, the capacitance between first plate 13 and second plate 14 will be larger (by a factor approximately equal to the dielectric constant of the print media 11) than the case in which media tray 12 is empty. When media tray 12 is partially full the capacitance value will be between the full and empty conditions.

With media tray 12 partially full of print media 11, the capacitance between first plate 13 and second plate 14 can be modeled as two capacitors in series, one of which has the dielectric constant of print media 11 and a plate separation equal to the thickness of the stack of print media 11 and the other capacitor having a dielectric constant of air and a plate separation equal to the thickness of the stack of print media 11 subtracted from the distance between first plate 13 and second plate 14.

As print media 11 stored in media tray 12 is consumed, the capacitance between first plate 13 and second plate 14 decreases. As the capacitance between first plate 13 and second plate 14 decreases (plate 13 is electrically coupled to first node 100 and plate 14 is coupled to second node 101) the frequency of the square wave output signal from first dual slope integrator 104 increases.

If a media type sensing device is not included in electrophotographic printer 1 there are alternative ways that the media quantity sensing device may be used to make an estimate of the amount of print media 11 remaining in media tray 12. Typically, when data is sent by host computer 30 to electrophotographic printer 1, included in that data is information specifying the number of units of print media 11 required to complete the print job. Alternatively, if this information is not provided by host computer 30, formatter 29 will determine the number of units of print media 11 required to complete the print job. Controller 31 could use the job size information in order to make a calibration measurement useful for determining the media quantity.

One way that this may be accomplished is as follows. Prior to the beginning of the print job, controller 31 performs a measurement, using frequency measurement unit 106, of the square wave output signal generated by first dual slope integrator 104. As each successive unit of print media 11 is removed from media tray 12, a measurement of the frequency of the square wave output signal is performed by controller 31. The relationship of the change in the frequency of the square wave output signal as a function of the number of units of print media 11 processed in the print job is characteristic of the type of print media 11 in media tray 12. Controller 31 then uses this empirically measured relationship to select the lookup table that will be used to determine the quantity of media remaining in media tray 12.

Without using successive frequency measurements as units; of print media 11 are removed from media tray 12, measurement of media quantity is still possible. In this case, the media quantity sensing device would use a single lookup table based upon a standard weight paper. For media types other than a standard weight paper, the output of the media quantity sensing device would be an approximation of the amount of print media remaining in media tray 12.

The quantity and type of media contained in media tray 12 could be available for user access through the front panel of electrophotographic printer 1. Alternatively, controller 31 could send the media type and quantity information to formatter 29 and then host computer 30 could load that information from electrophotographic printer 1.

The embodiments of the media quantity sensing device and the media type sensing device disclosed have several performance characteristics that make them particularly suited to the tasks of determining the quantity of media and determining the type of media. For example, neither of the sensing devices require contact with the media which lowers the risk of damage to the media and the risk of media jams. Nor do the sensing devices include optical components that can have their effectiveness degraded by contaminants such as paper fibers. Additionally, the media quantity sensing device and the media type sensing device have the capability to make their respective determinations of media quantity and media type on all the different media types potentially used in the imaging system. Furthermore, the embodiments of the media quantity sensing device and the media type sensing device are well suited for a low cost implementation. In addition, the embodiments of the media quantity sensing device and the media type sensing device can be made while printing is occurring and minimally impact the throughput of the imaging system.

The disclosed embodiments of the media quantity sensing device and the media type sensing device both provide substantial performance benefits to the imaging systems in which they are used. The media type determined by controller 31 allows the user to determine the type of media loaded into media tray 12 so that the user can determine if the media is suitable for the print job. Furthermore, the media type information determined by controller 31 can be used by the imaging system to optimize the imaging process.

Another possible beneficial use of the media type sensing device is in determining if the media type in media tray 12 matches the type desired for the print job. If the host computer 30 provided, along with print data, information specifying the type of media on which printing was to be done, controller 31 could compare the media type information obtained from the media type sensing device to the information provided by host computer 30 in order to ensure that the desired media was loaded into media tray 12. If the actual media in media tray 12 and the desired media for the print job do not correspond, the controller 31 could signal host computer 30, which in turn could signal the user and provide an opportunity for corrective action.

Yet another possible beneficial use of the media quantity sensing device is in pro-actively informing the user about the quantity of media in media tray 12. If host computer 30 provided print job information specifying the number of units of print media 11 necessary to complete the print job, electrophotographic printer 1 could use media quantity information from the media quantity sensing device to inform the user if there are sufficient units of print media 11 to complete the print job. This would allow a user to complete a print job more efficiently. More generally, electrophotographic printer 1, using information from the media quantity sensing device, could inform the user, either directly or through the host, that media tray 12 was nearly empty. This would allow the user to take the appropriate action.

Figure 7:
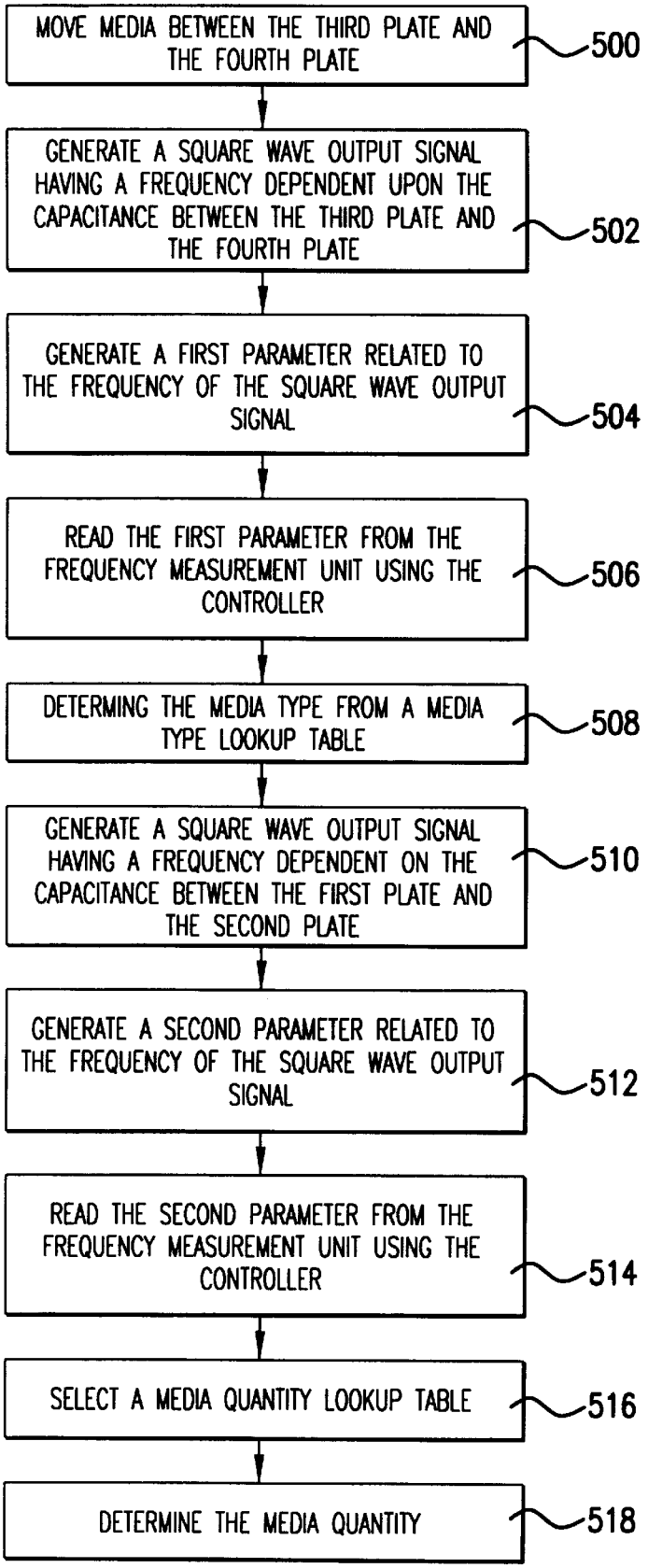
FIG. 7 shows a high level flow diagram of a method for using the media type sensing device and the media quantity sensing device.

Shown in FIG. 7 is a high level flow diagram of a method for using disclosed embodiments of the media type sensing device and the media quantity sensing device. In step 500, media is moved between third plate 17 and fourth plate 18. Next, in step 502, second dual slope integrator 105 generates a square wave output signal having a frequency dependent upon the capacitance between third plate 17 and fourth plate 18. Then, in step 504, frequency measuring unit 106 generates a first parameter related to the frequency of the square wave output signal. Next, in step 506, controller 31 reads the first parameter from the frequency measurement unit 106. Then, in step 508, controller 31 uses the first parameter to determine the media type from a media type lookup table. Next, in step 510, first dual slope integrator 104 generates a square wave output signal having a frequency dependent upon the capacitance between first plate 13 and second plate 14. Then, in step, 512, frequency measuring unit 106 generates a second parameter related to the frequency of the square wave output signal. Next, in step 514, controller 31 reads the second parameter from the frequency measurement unit 106. Then, in step 516, controller 31 uses the media type information to select a media quantity lookup table. Finally, in step 518, controller 31 accesses the selected media quantity lookup table using the second parameter to determine the media quantity.

Although several embodiments of the invention have been Illustrated, and their forms described, it is readily apparent to those of ordinary skill in the art that various modifications may be made to these embodiments without departing from the spirit of the invention or from the scope of the appended claims.

What is claimed is:

1. In a system for producing an image on media, an apparatus for generating a parameter related to a quantity of media in a media input device, comprising:

a first electrode;

a second electrode positioned opposite the first electrode so that the media in the media input device can be located between the first electrode and the second electrode; and a measuring circuit coupled to the first electrode and the second electrode, with the measuring circuit configured for generating the parameter based upon a property of a dielectric between the first electrode and the second electrode.

2. The apparatus as recited in claim 1, further comprising:

a controller arranged to receive the parameter from the measuring circuit and configured to determine the quantity of the media in the media input device based upon the parameter.

3. The apparatus as recited in claim 2, wherein:

the property of the dielectric includes a dielectric constant of the media, a dielectric loss of the media, or a dielectric leakage of the media; and the controller includes a configuration to determine the quantity of the media based upon the dielectric constant, the dielectric loss, or the dielectric leakage.

4. The apparatus as recited in claim 2, wherein:

the controller includes a configuration to access at least one lookup table for comparison with the parameter to determine the quantity of the media; and the property of the dielectric includes a dielectric constant of the media.

5. The apparatus as recited in claim 4, wherein:

the controller includes a configuration to access a plurality of the lookup tables with each of the lookup tables corresponding to a type of the media and the controller includes a configuration to select one of the lookup tables for comparison with the parameter based upon information relating to the type of the media in the media input device.

6. The apparatus as recited in claim 5, wherein:

the controller includes a configuration to generate the information based upon the parameter measured before and after removal of the media from the media input device.

7. The apparatus as recited in claim 5, wherein:

the controller includes a configuration to generate the information from data specifying the type of the media received by the system for producing the image;

the controller includes a configuration to compare the type of the media in the media input device to the type of the media indicated by the information to determine similarity; and the controller includes a configuration to determine the sufficiency of the quantity of the media in the media input device to produce the image on the media based upon data defining the image to be produced on the media received by the system for producing the image.

8. The apparatus as recited in claim 5, further comprising:

a third electrode coupled to the measuring circuit;

a fourth electrode coupled to the measuring circuit and positioned opposite the third electrode so that the media from the media input device can move between the third electrode and the fourth electrode;

with the parameter corresponding to a first parameter and the property corresponding to a first property, the measuring circuit includes a configuration for generating a second parameter based upon a second property of a dielectric between the third electrode and the fourth electrode; and the controller includes a configuration for determining the information based upon the second parameter.

9. The apparatus as recited in claim 8, wherein:

the second property of the dielectric includes the dielectric constant of the media.

10. The apparatus as recited in claim 9, wherein:

the first parameter includes a first frequency of a first signal generated by the measuring circuit and dependent upon the first property of the dielectric; and the second parameter includes a second frequency of a second signal generated by the measuring circuit and dependent upon the second property of the dielectric.

11. The apparatus as recited in claim 10, wherein:

each of the first electrode, the second electrode, the third electrode, and the fourth electrode includes a plate formed from a conductive material;

the position of the second electrode opposite the first electrode includes an orientation with the first electrode substantially parallel to the second electrode; and the position of the third electrode opposite the fourth electrode includes an orientation with the third electrode substantially parallel to the fourth electrode.

12. The apparatus as recited in claim 11, wherein:

the system for producing the image on the media includes an electrophotographic imaging system and the media input device includes a media tray.

13. In a system for producing an image on media including a first electrode, a second electrode, and a media input device, a method for determining a quantity of the media in the media input device, comprising:

generating a value based upon a property of a dielectric between the first electrode and the second electrode; and determining the quantity of the media in the media input device based upon the value.

14. The method as recited in claim 13, wherein:

determining the quantity of the media includes comparing the value to at least one lookup table.

15. The method as recited in claim 14, further comprising:

removing a unit of the media from the media input device with the removing occurring after generating the value;

with the value corresponding to a first value, generating a second value based upon the property of the dielectric with generating the second value occurring after removing the unit of the media; and determining the quantity of the media includes selecting the lookup table for comparison with the first value based upon the first value and the second value.

16. With the apparatus including a third electrode coupled to the measuring circuit and a fourth electrode coupled to the measuring circuit, the value corresponding to a first value, and the property corresponding to a first property, the method as recited in claim 14, further comprising:

generating a second value based upon a second property of a dielectric between the third electrode and the fourth electrode; and determining the quantity of the media in the media input device includes selecting the lookup table for comparison with the first value based upon the second value.

17. A system to produce an image on media loaded from a media input device, comprising:

an imaging device; and an apparatus for determining a quantity of the media in a media input device coupled to the imaging device, with the apparatus including a first electrode, a second electrode positioned opposite the first electrode so that the media can be located in the media input device between the first electrode and the second electrode, a measuring circuit coupled to the first electrode and the second electrode with the measuring circuit configured for generating a parameter based upon a property of a dielectric between the first electrode and the second electrode, and a controller arranged to receive the parameter from the measuring circuit and to determine the quantity of the media in the media input device based upon the parameter.

18. The system as recited in claim 17, wherein:

the controller includes a configuration to access at least one lookup table for comparing the lookup table with the parameter to determine the quantity of the media.

19. The system as recited in claim 18, further comprising:

a third electrode;

a fourth electrode positioned opposite the third electrode so that the media from the media input device can move between the third electrode and the fourth electrode, with the third electrode and the fourth electrode coupled to the measuring circuit, the parameter corresponding to a first parameter, the property corresponding to a first property, and the measuring circuit configured for generating a second parameter based upon a second property of a dielectric between the third electrode and the fourth electrode.

20. The system recited in claim 19, wherein:

the first parameter includes a first frequency;

the second parameter includes a second frequency;

the controller includes a configuration to select the lookup table for comparison with the first frequency based upon the second frequency;

the measuring circuit includes a first circuit to generate the first frequency dependent upon the first property of the dielectric including a dielectric constant of the media;

the measuring circuit includes a second circuit to generate the second frequency dependent upon the second property of the dielectric including the dielectric constant of the media; and the system to produce an image on the media includes an electrophotographic printing system.

* * * * *